US009839818B2

(12) United States Patent
Jertson et al.

(10) Patent No.: US 9,839,818 B2
(45) **Date of Patent: *Dec. 12, 2017**

(54) GOLF CLUB HEAD WITH CHAMFER AND RELATED METHODS

(71) Applicant: KARSTEN MANUFACTURING CORPORATION, Phoenix, AZ (US)

(72) Inventors: Martin R. Jertson, Phoenix, AZ (US); Eric J. Morales, Laveen, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/004,541

(22) Filed: Jan. 22, 2016

(65) Prior Publication Data

US 2016/0213985 A1 Jul. 28, 2016

Related U.S. Application Data

(60) Provisional application No. 62/107,269, filed on Jan. 23, 2015.

(51) Int. Cl.
*A63B 53/04* (2015.01)

(52) U.S. Cl.
CPC .. *A63B 53/0466* (2013.01); *A63B 2053/0408* (2013.01); *A63B 2053/0437* (2013.01)

(58) Field of Classification Search
CPC ..... A63B 53/0466; A63B 2053/0408; A63B 2053/0437; A63B 2053/0458; A63B 2053/045; A63B 53/08
See application file for complete search history.

(56) References Cited

U.S. PATENT DOCUMENTS

| | | | | |
|---|---|---|---|---|
| 5,482,279 | A * | 1/1996 | Antonious | A63B 53/04 473/327 |
| 6,248,025 | B1 * | 6/2001 | Murphy | A63B 53/04 473/324 |
| 6,267,690 | B1 | 7/2001 | Salmon | |
| 6,348,013 | B1 * | 2/2002 | Kosmatka | A63B 53/04 473/329 |
| 6,508,722 | B1 | 1/2003 | McCabe et al. | |
| 6,719,645 | B2 | 4/2004 | Kouno | |
| 7,435,191 | B2 * | 10/2008 | Tateno | A63B 53/0466 473/346 |
| 7,455,597 | B2 * | 11/2008 | Matsunaga | A63B 53/0466 473/329 |
| 7,479,070 | B2 | 1/2009 | Hirano | |
| 7,682,264 | B2 | 3/2010 | Hsu et al. | |

(Continued)

OTHER PUBLICATIONS

International Search Report dated Mar. 25, 2016 from corresponding PCT Application No. PCT/US2016/014555.

(Continued)

*Primary Examiner* — Steven Wong

(57) ABSTRACT

Some embodiments include a golf club head having a hollow body comprising a front portion having a strikeface, a heel region, a toe region opposite the heel region, a sole, a back, a crown portion, and a chamfer extending between the front portion and the crown portion, the chamfer having an inner surface and an outer surface, wherein the chamfer defines a hinge point of the crown portion.

19 Claims, 11 Drawing Sheets

(56) References Cited

U.S. PATENT DOCUMENTS

| | | | | |
|---|---|---|---|---|
| 7,762,909 | B2 * | 7/2010 | Sugimoto | A63B 53/0466 473/346 |
| 7,785,214 | B2 * | 8/2010 | Horacek | A63B 53/0466 473/345 |
| 7,927,229 | B2 | 4/2011 | Jertson | |
| 8,303,432 | B2 | 11/2012 | Curtis et al. | |
| 8,353,786 | B2 * | 1/2013 | Beach | A63B 53/0466 473/345 |
| 8,678,948 | B2 * | 3/2014 | Wada | A63B 53/0466 473/332 |
| 8,834,290 | B2 | 9/2014 | Bezilla et al. | |
| 8,858,360 | B2 * | 10/2014 | Rice | A63B 53/04 473/329 |
| 8,956,242 | B2 * | 2/2015 | Rice | A63B 53/0466 473/329 |
| 9,017,187 | B2 * | 4/2015 | Abe | A63B 53/0466 473/329 |
| 9,079,079 | B2 * | 7/2015 | Fossum | A63B 53/0466 |
| 2002/0055396 | A1 | 5/2002 | Nishimoto et al. | |
| 2003/0190975 | A1 | 10/2003 | Fagot | |
| 2004/0192463 | A1 | 9/2004 | Tsurumaki et al. | |
| 2009/0118032 | A1 * | 5/2009 | Hirano | A63B 53/0466 473/332 |
| 2011/0130213 | A1 | 6/2011 | Chiu | |
| 2011/0218053 | A1 | 9/2011 | Tang et al. | |
| 2011/0256954 | A1 | 10/2011 | Soracco | |
| 2012/0142447 | A1 * | 6/2012 | Boyd | A63B 53/0466 473/329 |
| 2012/0172145 | A1 * | 7/2012 | Kato | A63B 53/00 473/345 |
| 2013/0029782 | A1 * | 1/2013 | Goto | A63B 53/0466 473/345 |
| 2013/0165253 | A1 | 6/2013 | Rice et al. | |
| 2013/0252758 | A1 | 9/2013 | Chao et al. | |
| 2013/0281228 | A1 | 10/2013 | Horacek et al. | |
| 2013/0296071 | A1 | 11/2013 | Curtis et al. | |
| 2013/0303306 | A1 | 11/2013 | Curtis et al. | |
| 2013/0310194 | A1 | 11/2013 | Albertsen et al. | |
| 2014/0274457 | A1 | 9/2014 | Beach et al. | |
| 2015/0072803 | A1 | 3/2015 | Golden et al. | |
| 2015/0133234 | A1 * | 5/2015 | Ban | A63B 53/04 473/331 |
| 2016/0114228 | A1 * | 4/2016 | Jertson | A63B 53/0466 473/350 |
| 2016/0114229 | A1 * | 4/2016 | Jertson | A63B 53/0466 473/345 |

OTHER PUBLICATIONS

Tom Wishon, Clubhead Cup Face and How it Affects Performance, May 4, 2012, URL: http://wishongolf.com/the-clubhead-cup-face-and-how-it-affects-performance/.

Andrew Noyce, Titleist 915 Driver ARC Delivers Distance Without Compromise, Oct. 1, 2014, URL: http://www.golfalot.com/equipment-news/titleist-915-d2-d3-driver-distance-without-compromise-2999.aspx.

* cited by examiner

GOLF CLUB HEAD WITH CHAMFER AND RELATED METHODS

CROSS-REFERENCE TO RELATED APPLICATIONS

This claims the benefit of U.S. Provisional Patent Application No. 62/107,269, filed on Jan. 23, 2015, the entire contents of which are incorporated herein by reference.

TECHNICAL FIELD

This disclosure relates generally to sports equipment, and relates more particularly to golf club heads.

BACKGROUND

Golf club heads are designed to optimize performance characteristics, such as ball spin and travel distance. In low lofted clubs (e.g. hollow body club heads such as drivers, fairway woods, and hybrids), while a certain amount of backspin is needed to generate sufficient lift to keep the ball in the air, too much backspin can negatively affect overall carry distance. For example, when comparing two ball flights struck with the same club but having different amounts of backspin, the ball with too much backspin will curve upward more rapidly to a higher apex and subsequently fall more steeply (with a steeper descent angle) than the ball flight of the ball having less (or more optimal) backspin. Accordingly, the ball having too much backspin travels a shorter distance. While golf clubs have a variety of known designs, there is a need for further reducing golf ball spin, or spin rate in lower lofted golf clubs to maximize distance.

Figure 1:
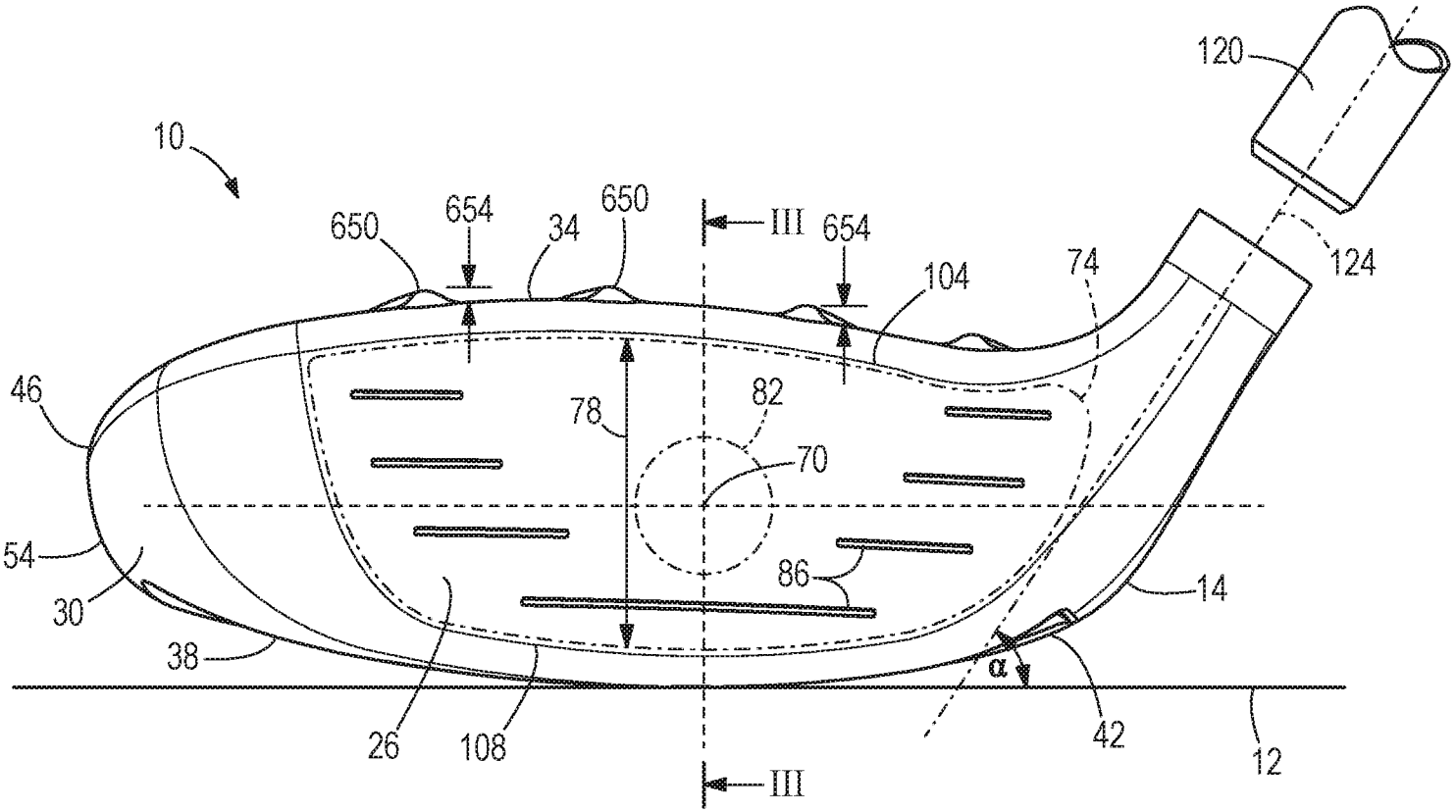
FIG. 1 illustrates a front view of a golf club head according to one embodiment of the invention.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

DETAILED DESCRIPTION

One embodiment includes a golf club head comprising a hollow body with a front portion having a strikeface, a crown portion, and a chamfer extending between the front portion and the crown portion, the chamfer defining a hinge point of the crown portion. The chamfer defines a plane, and an angle between the chamfer plane and the loft plane can be approximately 45 degrees. The chamfer shifts the hinge point toward a rear portion of the club head, and allows increased bending of the crown portion and strikeface of the club head on impact with a golf ball compared to a similar club head without a chamfer. Increased bending of the crown and strikeface allow increased energy transfer to the golf ball and/or reduced spin on the golf ball resulting in increased travel distance.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Some embodiments include a golf club head comprising a hollow body with a front portion having a strikeface, a heel portion, a toe portion opposite the heel portion, a sole portion, a rear portion, a crown portion, and a chamfer extending between the front portion and the crown portion, the chamfer having an inner surface and an outer surface, wherein the chamfer defines a hinge point of the crown portion. In these or other embodiments, the strikeface defines a loft plane and the hinge point is spaced apart from the loft plane by a minimum of approximately 0.16 inches in a direction perpendicular to the loft plane. Further, in these or other embodiments, the chamfer defines a plane tangent to the inner surface of the chamfer, and an angle between the chamfer plane and the loft plane can be approximately 45 degrees. In these or other embodiments, the chamfer can provide spin reduction of 100-400 revolutions per minute (rpm) of a golf ball. In these or other embodiments, the strikeface can have a surface roughness between 100 $R_a$ and 190 $R_a$.

In some embodiments, the golf club head comprises a driver having a chamfer with a width of between approximately 0.75 and approximately 4.50 inches, a length of between approximately 0.15 inches and approximately 0.25 inches, and a maximum thickness of between approximately 0.095 inches and approximately 0.150 inches, wherein the maximum thickness is measured between the inner surface and the outer surface of the chamfer. In these or other embodiments, a ratio of the maximum thickness to a thickness of the crown measured adjacent to the chamfer can be between approximately 1.15 and 3.00.

In some embodiments, the golf club head comprises a fairway wood having a chamfer with width of between approximately 0.75 and approximately 3.50 inches, a length of between approximately 0.05 inches and approximately 0.25 inches, and a maximum thickness of between approximately 0.025 inches and approximately 0.070 inches, wherein the maximum thickness is measured between the inner surface and the outer surface of the chamfer. In these or other embodiments, a ratio of the maximum thickness to a thickness of the crown measured adjacent to the chamfer can be between approximately 1.15 and 4.00.

In some embodiments, the golf club head can be part of a golf club, the club head comprising a hollow body with a front portion having a strikeface, a heel portion, a toe portion opposite the heel portion, a sole portion, a rear portion, a crown portion, and a chamfer extending between the front portion and the crown portion, the chamfer having an inner surface and an outer surface, wherein the chamfer defines a hinge point of the crown portion. In these or other embodiments, the strikeface defines a loft plane and the hinge point is spaced apart from the loft plane by a minimum of approximately 0.16 inches in a direction perpendicular to the loft plane. Further, in these or other embodiments, the chamfer defines a plane tangent to the inner surface of the chamfer, and an angle between the chamfer plane and the loft plane can be approximately 45 degrees. In these or other embodiments, the chamfer can provide spin reduction of 100-400 revolutions per minute (rpm) of a golf ball. In these or other embodiments, the strikeface can have a surface roughness between 100 $R_a$ and 190 $R_a$.

In some embodiments, the golf club comprises a driver having a club head with a chamfer having a width of between approximately 0.75 and approximately 4.50 inches, a length of between approximately 0.15 inches and approximately 0.25 inches, and a maximum thickness of between approximately 0.095 inches and approximately 0.150 inches, wherein the maximum thickness is measured between the inner surface and the outer surface of the chamfer. In these or other embodiments, a ratio of the maximum thickness to a thickness of the crown measured adjacent to the chamfer can be between approximately 1.15 and 3.00.

In some embodiments, the golf club comprises a fairway wood having a club head with a chamfer having a width of between approximately 0.75 and approximately 3.50 inches, a length of between approximately 0.05 inches and approximately 0.25 inches, and a maximum thickness of between approximately 0.025 inches and approximately 0.070 inches, wherein the maximum thickness is measured between the inner surface and the outer surface of the chamfer. In these or other embodiments, a ratio of the maximum thickness to a thickness of the crown measured adjacent to the chamfer can be between approximately 1.15 and 4.00.

Some embodiments include a method of manufacturing the golf club head comprising providing a body, the body having a front portion having a strikeface, a heel portion, a toe portion opposite the heel portion, a sole portion, a rear portion, a crown portion, and a chamfer extending between the front portion and the crown portion, and defining a hinge point of the crown portion.

Figure 2:
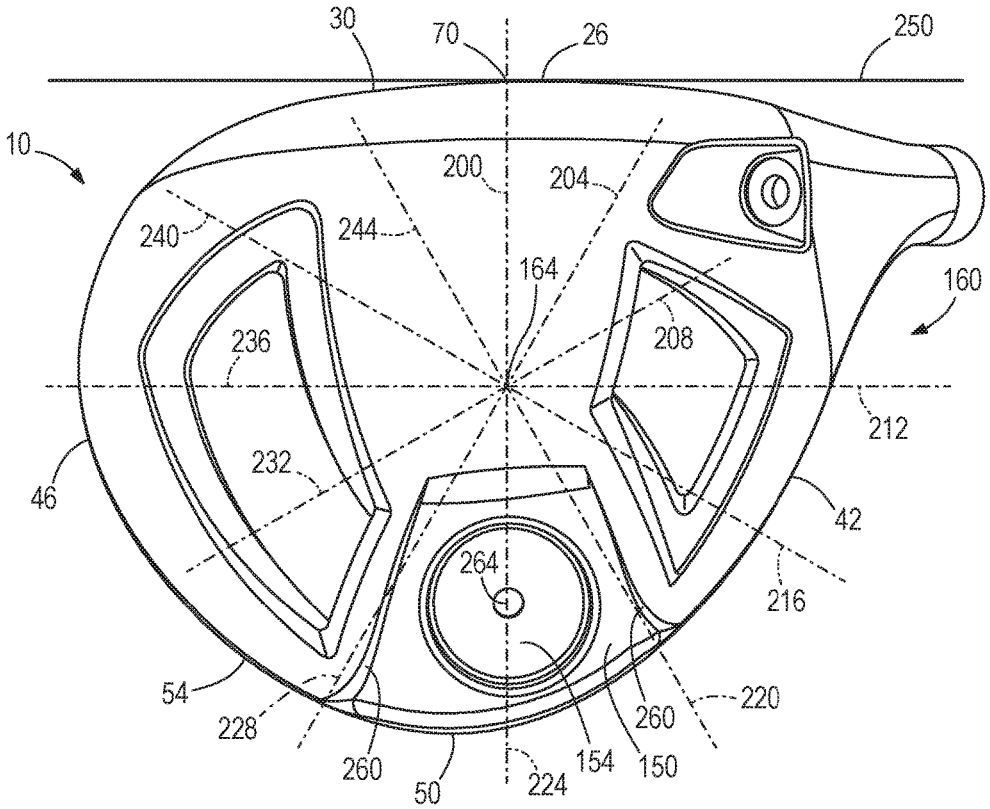
FIG. 2 illustrates a bottom view of the golf club head of FIG. 1.
Figure 3:
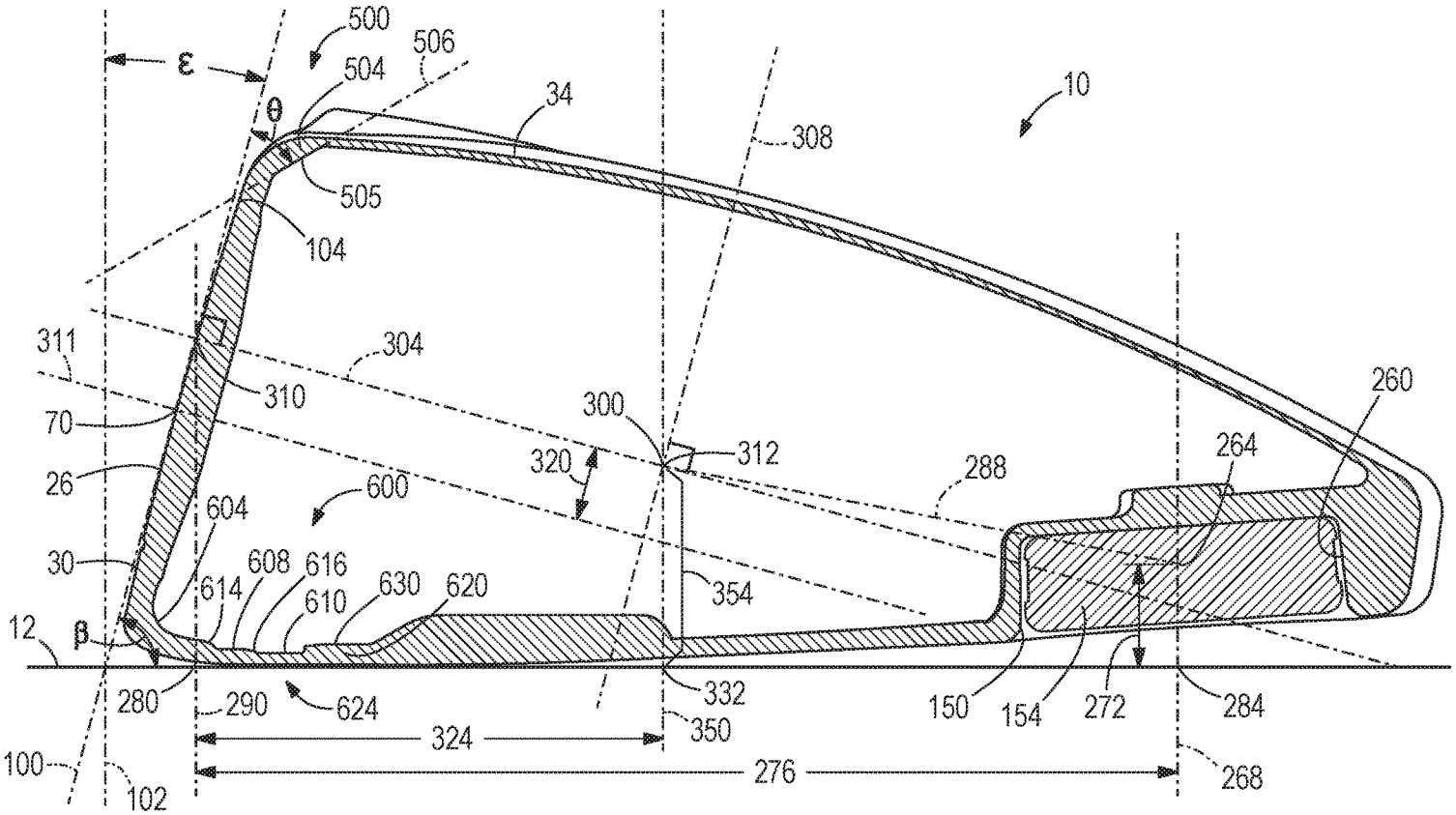
FIG. 3 illustrates a side cross-sectional view of the golf club head along line of FIG. 1.

FIGS. 1-5 illustrate a golf club head 10, which can be any type of hollow body golf club head, such as a wood-type golf club head (e.g., a fairway wood-type golf club head), a driver-type golf club head, or a hybrid-type golf club head. FIGS. 1 and 3 present the golf club head 10 at an address position relative to a ground plane 12. The golf club head 10 includes a body 14 that has a strikeface 26, a front portion 30, a crown portion 34, a sole portion 38, a heel portion 42, a toe portion 46, and a rear portion 50. The front portion 30 includes the strikeface 26. The rear portion 50 includes a trailing edge 52 that extends at least partially between the heel portion 42 and the toe portion 46. A skirt portion 54 extends between the trailing edge 52 and the sole portion 34. FIG. 3 illustrates a side cross-sectional view of the golf club head 10 towards the face portion 18 along line of FIG. 1. FIG. 2 illustrates a top view of the golf club head 10. The body 14 and the strikeface 26 comprise separate pieces of material coupled together, for example, via a welding process or can be formed as one piece.

With reference to FIG. 1, the strikeface 26 has a centerpoint 70, a perimeter 74, and a face height 78. In one construction, the centerpoint 70 is located at a geometric centerpoint of the perimeter 74 and at a midpoint of the face height 78. In the same or other constructions, the centerpoint 70 also can be centered with respect to an engineered impact zone 82, which can be defined by a region of grooves 86 on the strikeface 26. It is noted that the centerpoint 70 may or may not represent the center of the club head 10. In other constructions, the centerpoint 70 can be located in accordance with the definition of a golf governing body such as the United States Golf Association (USGA). For example, the centerpoint 70 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

With further reference to FIGS. 1 and 3, the golf club head 10 comprises a loft plane 100 (FIG. 3), which is at least tangent to the centerpoint 70 of the strikeface 26. The loft plane 100 is oriented at an angle $\beta$ with respect to the ground plane 12 and an angle $\epsilon$ with respect to an axis 102 that is perpendicular to the ground plane 12. The face height 78 can be measured parallel to the loft plane 100 between a first end 104 of the strikeface 26 and a second end 108 of the strikeface 26. The face height 78 varies depending on the type of club. For example, the face height 78 for a fairway wood can be approximately 35 millimeters (mm), while the face height 78 for a driver can be approximately 50 mm. The face height 78 for additional or alternative fairway woods may range from 25-50 mm in the present or other examples, while the face height 78 for additional or alternative drivers may range from 40-80 mm in other examples. In additional or alternative constructions, the perimeter 74 of the strikeface 26, comprising at least the first end 104 and the second end 108 defining the face height 78, may include alternative configurations than illustrated herein.

With continued reference to FIG. 1, the body 14 of the golf club head 10 comprises a hosel 120. The hosel 120 includes a hosel axis 124 extending along a center of a bore of the hosel 120. In the present example, a hosel coupling mechanism of the golf club head 10 comprises the hosel 120 and a shaft sleeve (not shown), where the shaft sleeve can be coupled to an end of a golf shaft (not shown). The shaft sleeve can couple with the hosel 120 in a plurality of configurations, thereby permitting the golf shaft to be secured to the hosel 120 at a plurality of angles relative to the hosel axis 124. There can be other examples, however, where the shaft can be non-adjustably secured to the hosel 120. In the illustrated embodiment, the hosel axis 124 is at an angle $\alpha$ with the ground plane 12 with respect to a front view of the golf club head 10 (FIG. 1). The illustrated angle $\alpha$ is approximately 60-degrees, but in other constructions, the angle $\alpha$ may be between approximately 40-80 degrees (e.g., approximately 40 degrees, approximately 45 degrees, approximately 50 degrees, approximately 55 degrees, approximately 60 degrees, approximately 65 degrees, approximately 70 degrees, approximately 75 degrees, or approximately 80 degrees).

As can be seen in FIGS. 2 and 3, the golf club head 10 also includes a weight assembly 150 that has a weight 154, which may be removable and may be located relative to a clock grid 160, which can be aligned with respect to the strikeface 26. For example, the clock grid 160 comprises rays each corresponding to an hour of a clock. Each ray passes through a clock grid centerpoint 164. As illustrated, the clock grid 160 includes a 12 o'clock ray 200, a 1 o'clock ray 204, a 2 o'clock ray 208, a 3 o'clock ray 212, a 4 o'clock ray 216, a 5 o'clock ray 220, a 6 o'clock ray 224, a 7 o'clock ray 228, a 8 o'clock ray 232, a 9 o'clock ray 236, a 10 o'clock ray 240, and an 11 o'clock ray 244. The 12 o'clock ray 200 is aligned with the centerpoint 70 of the strikeface 26 in the present embodiment when viewed from a bottom view, as illustrated in FIG. 2. The 12 o'clock ray 200 is orthogonal to a front intersection line 250, which is defined by the intersection of the loft plane 100 (FIGS. 2-3) and the ground plane 12 (FIGS. 1-3). The clock grid 160 can be centered along the 12 o'clock ray 200, at a midpoint between a front end of the front portion 30 and the rear end of the rear portion 50. The 3 o'clock ray 212 extends towards the heel portion 42, and the 9 o'clock ray 236 extends towards the toe portion 46 as shown in FIG. 2. In the same or other examples, the clock grid centerpoint 164 can be centered proximate to a geometric centerpoint of golf club head 10.

The weight assembly 150 includes a perimeter 260 located in the present embodiment towards the rear portion 50, at least partially bounded between the 4 o'clock ray 216 and the 8 o'clock ray 232 of the clock grid 160, while a center 264 of the weight 154 is located between the 5 o'clock ray 220 and the 7 o'clock ray 228. In examples such as the present one, the perimeter 260 is fully bounded between the 4 o'clock ray 216 and the 8 o'clock ray 232. Although the perimeter 260 is defined external to the golf club head 10 in the present example, there can be other examples where a weight perimeter may extend into an interior of, or be defined within, the golf club head 10. In some examples, the location of weight 150 can be established with respect to a broader area. For instance, in such examples, the weight perimeter 260 of the weight assembly 150 can be located towards the rear portion 50, at least partially bounded between the 4 o'clock ray 216 and the 9 o'clock ray 236 of the clock grid 160, while the center 264 of the weight 154 can be located between the 5 o'clock ray 220 and the 8 o'clock ray 232.

In the same or other embodiments, the weight assembly 150 can extend or be shifted towards the heel portion 42. For example, the perimeter 260 and/or the center 264 of the weight 154 can be shifted towards the 4 o'clock ray 216.

With respect to FIG. 3, the center 264 of the weight 154 can be located with respect to the ground plane 12 and a weight center elevation axis 268, which extends between the weight center 264 and the ground plane 12. The weight center elevation axis 268 is orthogonal to the ground plane 12 when the golf club head 10 is at the address position. A weight center elevation 272 for the center 264 of the weight 154 can thus be measured along the weight center elevation axis 264, between the weight center 264 and the ground plane 12. In addition, a weight center depth 276 for the center 264 of the weight 154 can be measured, parallel to the ground plane 12, between intersection points 280, 284. In the present example, the intersection point 280 is defined by the intersection between the ground plane 12 and a front plane 290, where the front plane 290 extends through a location 310 (which will be discussed in greater detail below) on the strikeface 26, is parallel to the hosel axis 124 (FIG. 1), and is orthogonal to the ground plane 12 when the golf club head 10 is at the address position. The intersection point 284 is defined by the intersection between the ground plane 12 and the weight center elevation axis 268 when the golf club head 10 is at the address position.

Further with respect to FIG. 3, the golf club head 10 also comprises a center of gravity (CG) 300, a depth plane 304, and a CG height axis 308. The depth plane 304 extends through the CG 300 and the location 310 on the strikeface 26 that is offset from the strikeface centerpoint 70 and perpendicular to the loft plane 100. The CG height axis 308 extends through the CG 300 and intersects the depth plane 304 perpendicularly at an intersection point 312. The center 264 of the weight 154 can be located in the same or other embodiments such that a weight distance 288 (FIG. 3), which separates the CG 300 from the center 264 of the weight 154, is approximately 25 mm to approximately 102 mm.

Also as shown in FIG. 3, a plane 311 extends through the strikeface centerpoint 70 and is parallel to the head depth plane 304. The CG 300 comprises a CG height 320 above the plane 311. Additionally, a CG depth 324 locates the CG 300 relative to the golf club head 10. In the present example, the CG height 320 can be measured along the CG height axis 308, between the CG 300 and plane 311. The CG depth 324 can be measured parallel to ground plane 12 and between the intersection point 280 and an intersection point 332 that is defined by the intersection between the ground plane 12 and a vertical axis 350, where the vertical axis 350 extends through the CG 300, and is orthogonal to the ground plane 12 when the golf club head 10 is at the address position. The CG 300 can also be located relative to the ground plane 12, where a CG elevation 354 of the CG 300 can be measured along the vertical axis 350, between the CG 300 and the ground plane 12.

Figure 3A:
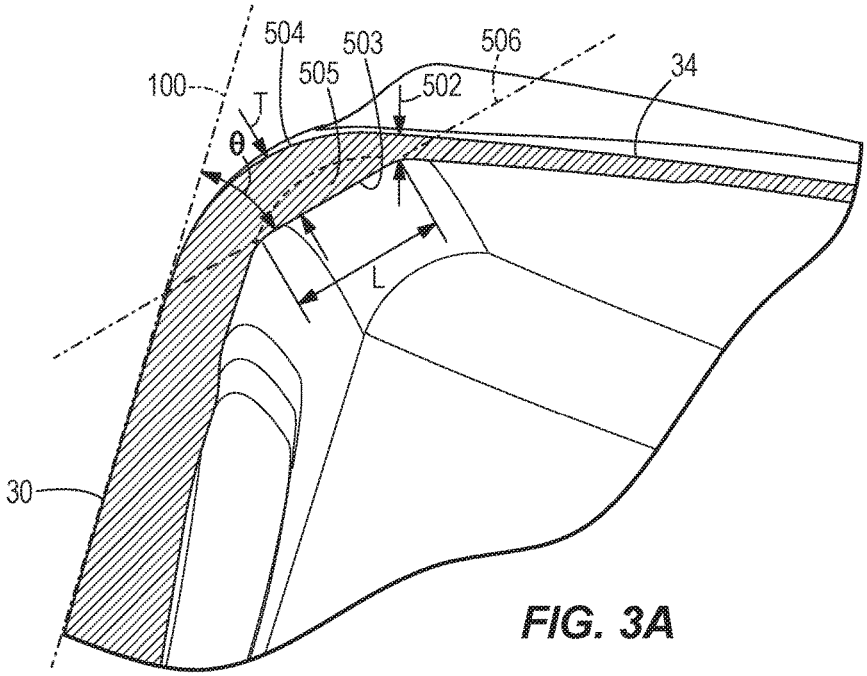
FIG. 3A illustrates an enlarged view of a portion of FIG. 3.
Figure 4:
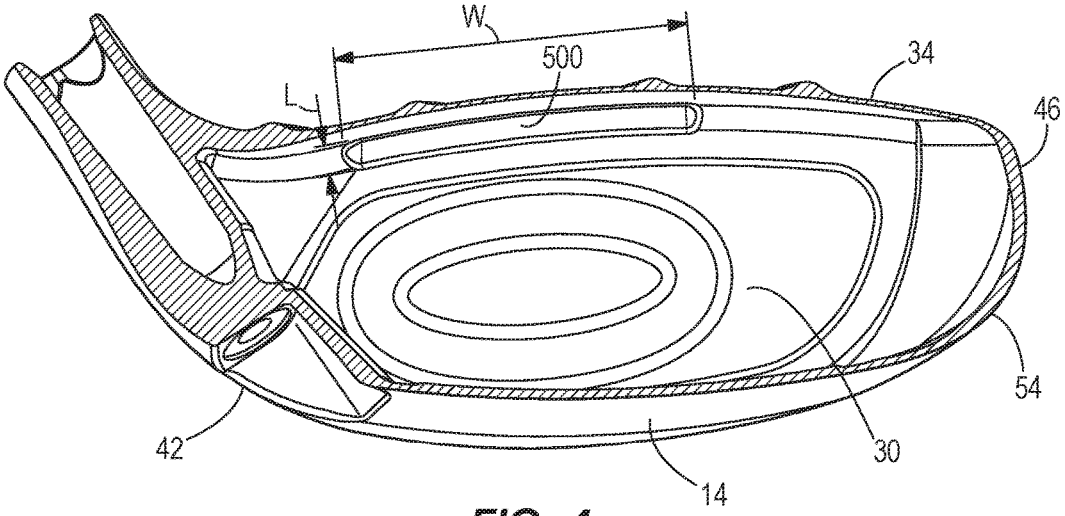
FIG. 4 illustrates the golf club head of FIG. 1 with a rear portion removed.
Figure 5:
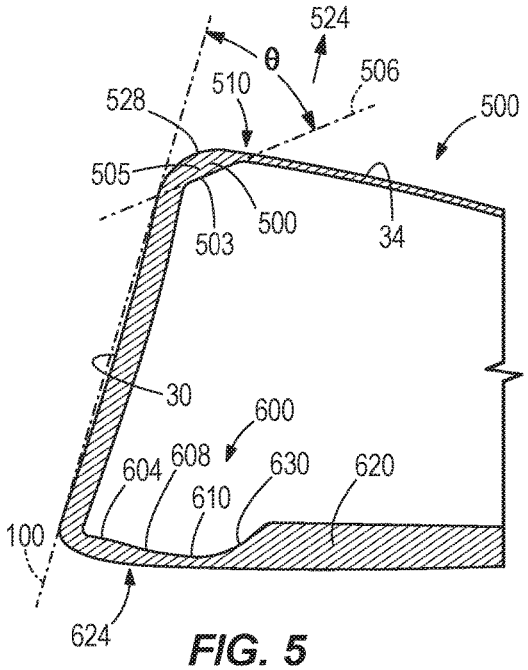
FIG. 5 illustrates a finite element analysis of a portion of the golf club head of FIG. 1.

As shown in FIGS. 3-5, the golf club head 10 also includes a chamfer 500 formed between at least a portion of the front portion 30 and the crown portion 34. For example and with renewed reference to FIG. 3, the chamfer 500 extends between the first end 104 of the strikeface 26 and the crown portion 34. The chamfer 500 includes an outer surface 504 and an inner surface 503 that define a thickness therebetween. The thickness may be consistent or may vary along the length of the chamfer 500. As illustrated in FIGS. 3 and 3A, the thickness between the outer surface 504 and the inner surface 503 defines a thickened portion 505 of the body 14 between the front portion 30 and the crown portion 34. The chamfer 500 defines a gently sloping outer surface 504 that extends between the front portion 30 and the crown portion 34. The inner surface 503 defines a plane or chamfer plane 506 that is oriented at an angle θ relative to the loft plane 100. The angle θ in the illustrated embodiment is approximately 45 degrees, although in other or additional embodiments, the angle θ may be in the range of approximately 30 degrees and 60 degrees (e.g., approximately 31 degrees, approximately 32 degrees, approximately 33 degrees, approximately 34 degrees, approximately 35 degrees, approximately 36 degrees, approximately 37 degrees, approximately 38 degrees, approximately 39 degrees, approximately 40 degrees, approximately 41 degrees, approximately 42 degrees, approximately 43 degrees, approximately 44 degrees, approximately 45 degrees, approximately 46 degrees, approximately 47 degrees, approximately 48 degrees, approximately 49 degrees, approximately 50 degrees, approximately 51 degrees, approximately 52 degrees, approximately 53 degrees, approximately 54 degrees, approximately 55 degrees, approximately 56 degrees, approximately 57 degrees, approximately 58 degrees, or approximately 59 degrees). For example, in some embodiments, the angle θ may be in the range of approximately 30 degrees to 45 degrees, approximately 45 degrees to 60 degrees, approximately 30 degrees to 40 degrees, approximately 40 degrees to 50 degrees, or approximately 50 degrees to 60 degrees.

Figure 5A:
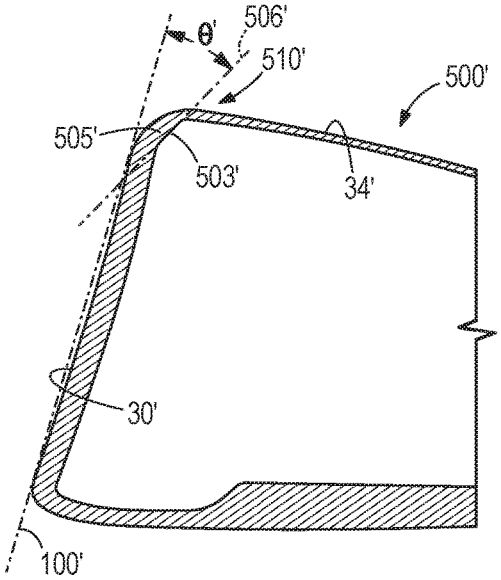
FIG. 5A PRIOR ART
FIG. 5A illustrates a finite element analysis of a portion of a conventional golf club head.
Figure 5B:
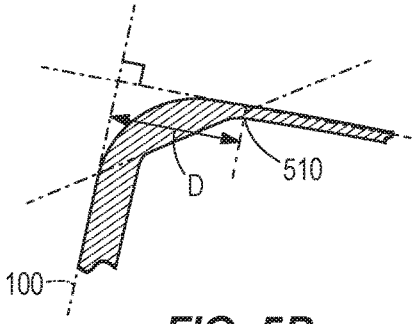
FIG. 5B is a detailed view of the circumscribed portion of FIG. 5.
Figure 5C:
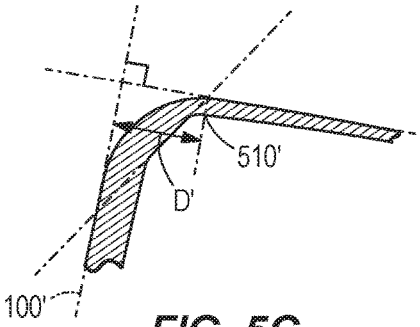
FIG. 5C PRIOR ART
FIG. 5C is a detailed view of the circumscribed portion of FIG. 5A.

As illustrated in FIGS. 5 and 5A, the chamfer 500 moves a hinge point 510 (FIG. 5) between the front portion 30 and the crown portion 34 towards the rear portion 50 and away from the strikeface 26. As illustrated in FIGS. 5B and 5C, the hinge point 510, 510' (e.g., the plastic hinge) is spaced apart from the respective loft plane 100, 100' by a distance D, D' measured in a direction perpendicular from the loft plane 100, 100'. The distance D of the golf club head 10 with the chamfer 500 is greater than the distance D' of the conventional golf club head 10'. In the illustrated embodiment, the distance D is approximately 0.18 inches. However, in additional or alternative embodiments, the distance D is a minimum distance ranging from approximately 0.10 inches (2.54 mm) to approximately 0.5 inches (12.7 mm). For example, the distance can be approximately 0.10 inches (2.54 mm), approximately 0.11 inches (2.79 mm), approximately 0.12 inches (3.05 mm), approximately 0.13 inches (3.3 mm), approximately 0.14 inches (3.56 mm), approximately 0.15 inches (3.81 mm), approximately 0.16 inches (4.06 mm), approximately 0.17 inches (4.32 mm), approximately 0.18 inches (4.57 mm), approximately 0.19 inches (4.83 mm), approximately 0.20 inches (5.08 mm), approximately 0.21 inches (5.33 mm), approximately 0.22 inches (5.59 mm), approximately 0.23 inches (5.84 mm), approximately 0.24 inches (6.10 mm), approximately 0.25 inches (6.35 mm), approximately 0.26 inches (6.60 mm), approximately 0.27 inches (6.86 mm), approximately 0.28 inches (7.11 mm), approximately 0.29 inches (7.37 mm), approximately 0.30 inches (7.62 mm), approximately 0.31 inches (7.87 mm), approximately 0.32 inches (8.12 mm), approximately 0.33 inches (8.38 mm), approximately 0.34 inches (8.64 mm), approximately 0.35 inches (8.89 mm), approximately 0.36 inches (9.14 mm), approximately 0.37 inches (9.40 mm), approximately 0.38 inches (9.65 mm), approximately 0.39 inches (9.91 mm), approximately 0.40 inches (10.2 mm), approximately 0.41 inches (10.4 mm), approximately 0.42 inches (10.7 mm), approximately 0.43 inches (10.9 mm), approximately 0.44 inches (11.2 mm), approximately 0.45 inches (11.4 mm), approximately 0.46 inches (11.7 mm), approximately 0.47 inches (11.9 mm), approximately 0.48 inches (12.2 mm), approximately 0.49 inches (12.4 mm), or approximately 0.50 inches (12.7 mm).

FIGS. 5 and 5A show a finite element comparison of the golf club head 10, which has the chamfer 500, and a golf club head 500' without the chamfer during impact of a force, such as from that of a golf ball. Like the golf club head 10, the golf club head 10' includes an inner surface 503' between the front portion 30' and the crown portion 34'. The inner surface 503' is oriented at an angle θ' with respect to the loft plane 100'. The angle θ' is less than the angle θ.

As can be seen in the comparison between FIGS. 5 and 5A, the stress that results from the impact is redistributed such that it is concentrated in the area of the hinge point 510 of the golf club head 10. By comparison, the stress at the hinge point 510 of the club head 10 is significantly greater than a comparable area 510' of the club head 10' between the front portion 30' and the crown portion 34' of the golf club head 500'. FIG. 5 also illustrates that the chamfer 500 creates a fulcrum 528. The fulcrum 528 has essentially no stress, which speaks again to the distribution of stress provided by the inventive features of the club head 10.

The chamfer 500 results in a greater amount of internal energy transferred to the golf club head 10 during impact, such that a greater amount of internal energy of the golf club head 10 is transferred back to the ball. This is because the effect of the higher concentrations of stress at the hinge point 510 results in a greater bowing or a peak bending (e.g., movement in the direction of 524) of the crown portion 34 than that of the golf club head 500'. The greater bowing of the crown portion 34 causes an uneven bowing effect with bowing of the sole portion 38. Stated another way, the chamfer 500 is acts as a "plastic hinge" at the peak bending (e.g., the hinge point 510), promoting more localized deformation due to impact with the golf ball. The chamfer 500 separates spin influence from the CG 300, while still allowing for a high MOI of the club. As such, the chamfer 500 results in a lower spin due to dynamic face shearing and net loft during the ball impact. The chamfer 500 provides a spin reducing hinge. In other words, adding the chamfer 500 as described herein between the front portion 30 and the crown portion 34 changes the timing of the face response, leading to spin reductions of 100-400 rpm. The introduction of the chamfer 500 overcomes the need to move the CG 300 forward, which lowers the MOI. The chamfer 500 allows for the CG 300 to be closer to the rear portion 50 and the MOI to remain high, which provides maximum forgiveness but also lowers the spin of the ball.

Figure 6:
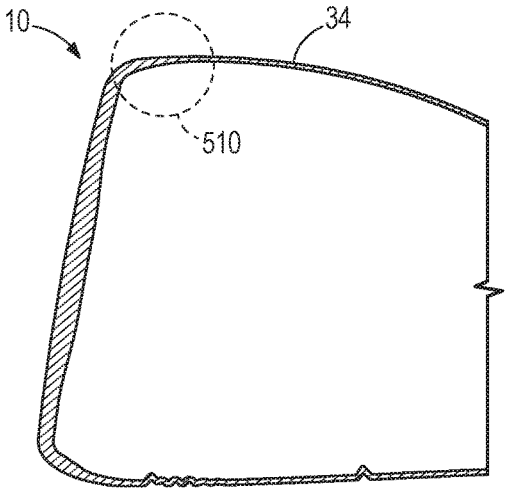
FIG. 6 illustrates a finite element analysis of a portion of a golf club head according to another embodiment of the disclosure in a first position.
Figure 6A:
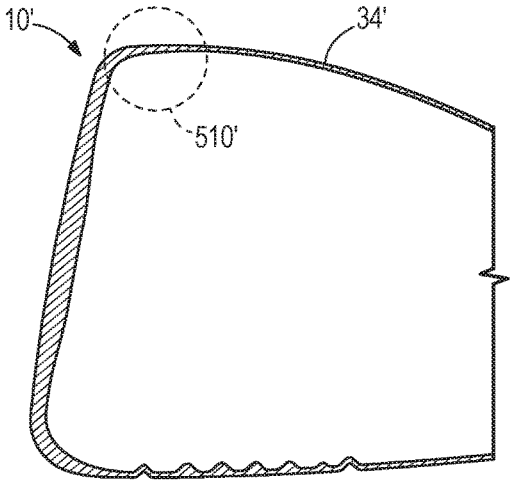
FIG. 6A PRIOR ART
FIG. 6A illustrates a finite element analysis of a portion of a conventional golf club head in a first position.
Figure 7:
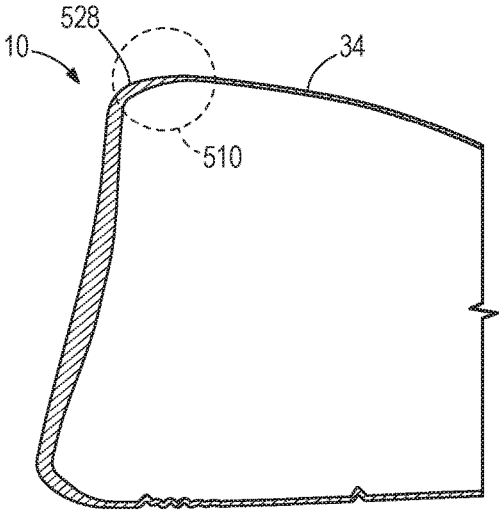
FIG. 7 illustrates a finite element analysis of the portion of the golf club head of FIG. 6 in a second position.
Figure 7A:
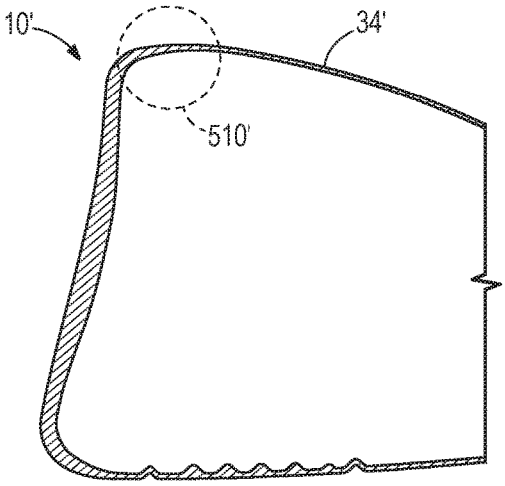
FIG. 7A PRIOR ART
FIG. 7A illustrates a finite element analysis of the portion of the golf club head of FIG. 6A in a second position.
Figure 8:
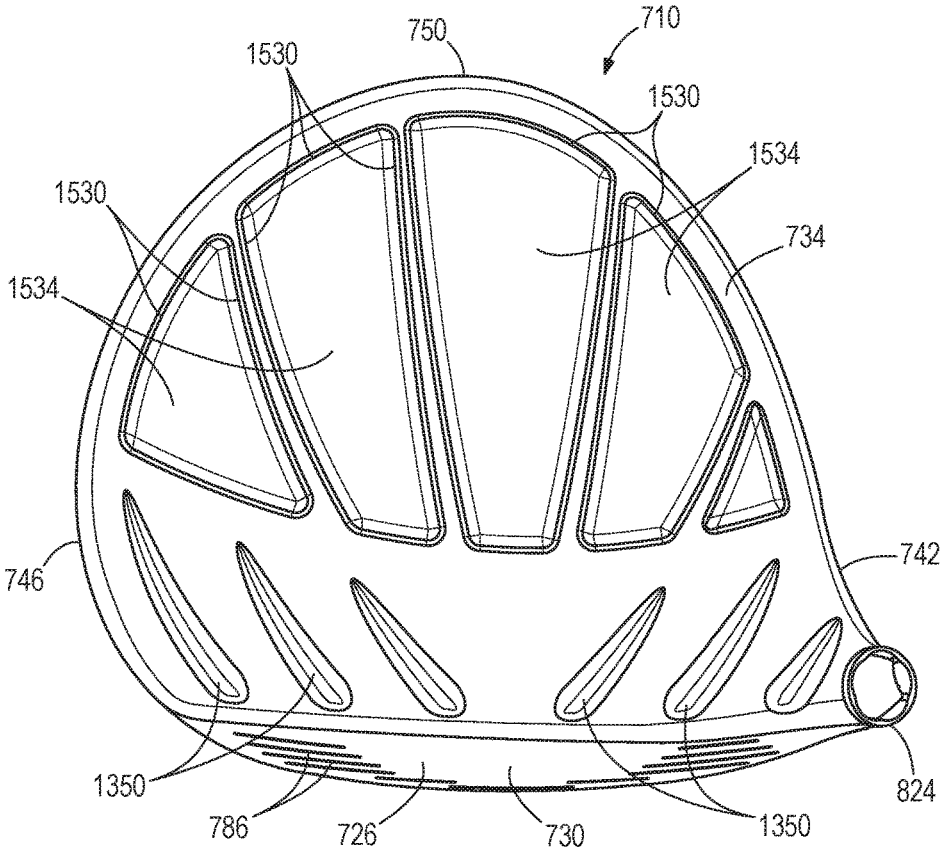
FIG. 8 illustrates a top view of a golf club head according to another embodiment of the disclosure.
Figure 9:
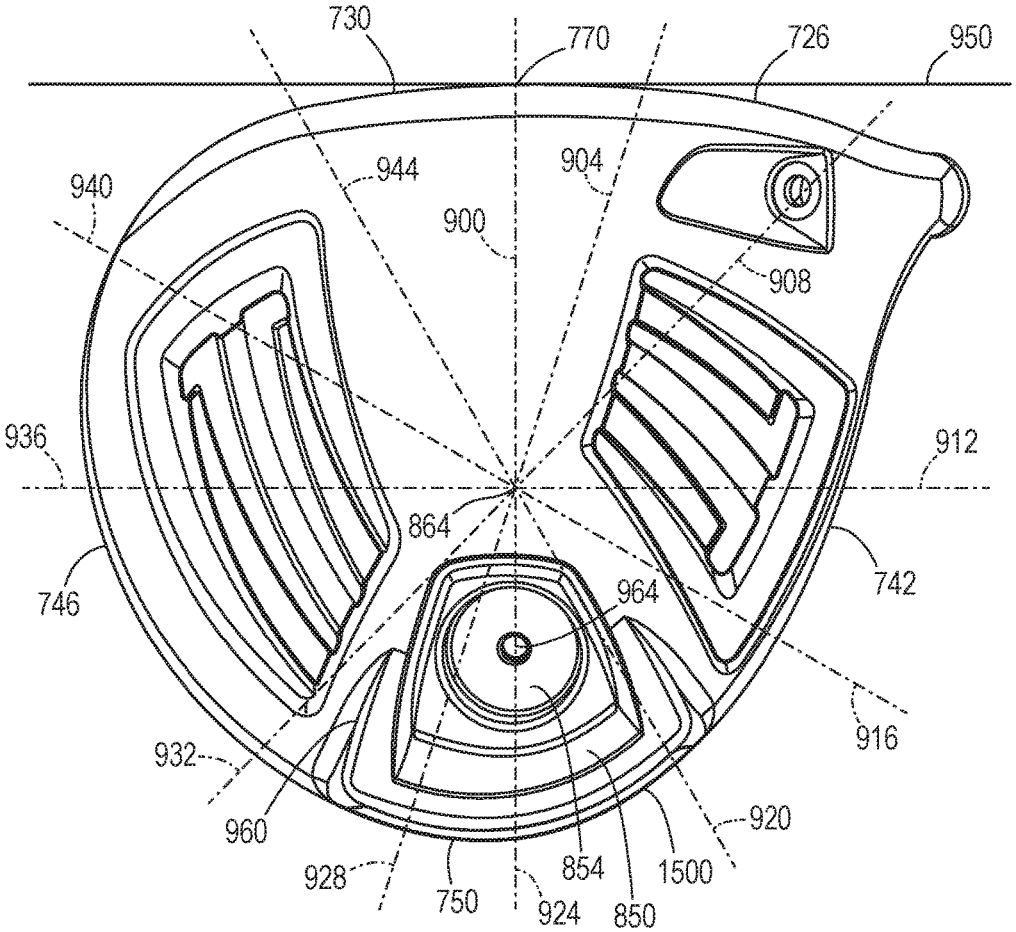
FIG. 9 illustrates a bottom view of the golf club head of FIG. 9.
Figure 10:
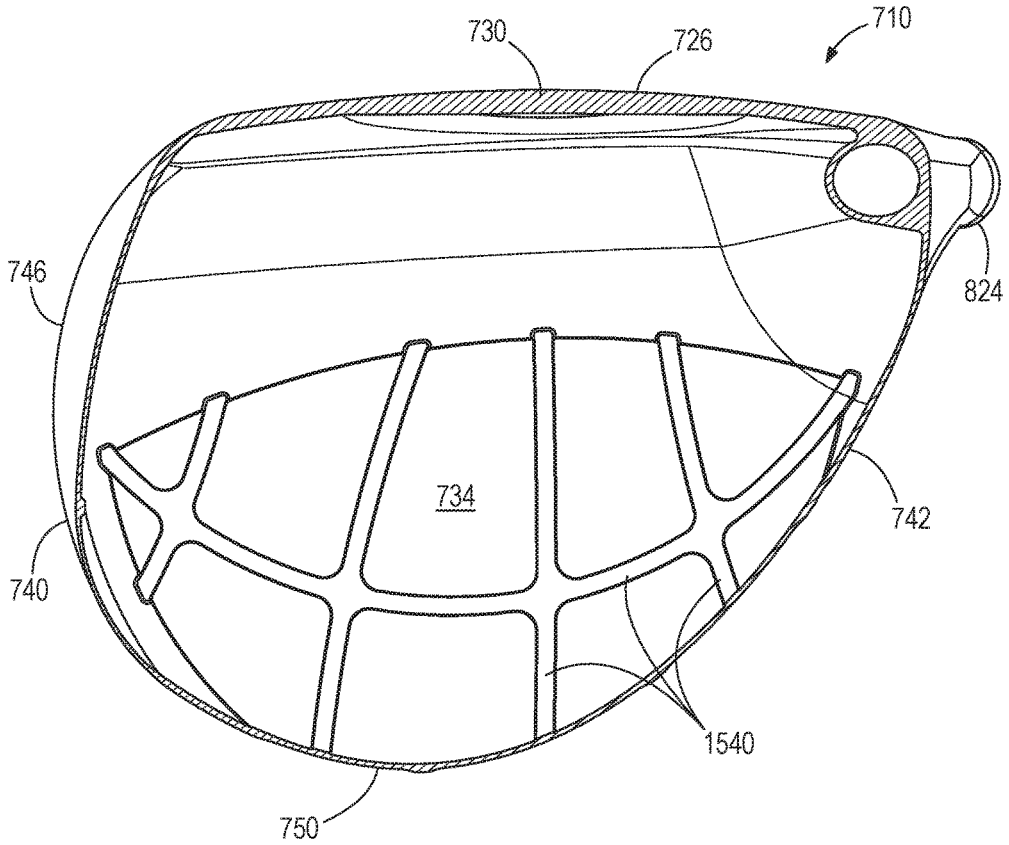
FIG. 10 illustrates a bottom view of the golf club head of FIG. 8 with a sole portion removed.

Referring to FIGS. 6 and 6A, the chamfer 500 on the club head 10 moves the hinge point 510 toward the rear end 50 and away from the strike face, thereby allowing the club head 10 to bow outward to a greater extent than a conventional golf club head 10' on impact with a golf ball. Increased bowing of the club head 10 allows increased bending of the strikeface 26 on impact with a golf ball. Increased bending of the strikeface 26 can increase energy transfer to the golf ball resulting in increased ball speeds. Further, increased bending of the strikeface 26 can reduce spin on the golf ball to increase travel distance. FIGS. 6 and 6A illustrate the difference in the bowing of the crown portions 34, 34' under impact. FIGS. 6 and 6A illustrate the starting shapes of each of the crown portions 34, 34' as a basis for comparison of the bowing illustrated in FIGS. 7 and 7A, respectively.

In the illustrated embodiment, the chamfer 500 is positioned above the perimeter 74 of the strikeface 26 and has dimensions that vary depending on the club head type. For example, a width W of the chamfer 500, which is measured in the direction of the heel portion 42 and the toe portion 46, can be approximately 0.75 inches to 3.50 inches (e.g., approximately 19 mm to 90 mm) for a fairway wood and approximately 0.75 inches to 4.50 inches (e.g., approximately 19 mm to 115 mm) for a driver. In some embodiments, the width W of the chamfer 500 can extend from the heel portion 42 to the toe portion 46 of the club head. In the illustrated embodiment, the chamfer is continuous along the width W. In other embodiments, the chamfer can be discontinuous. For example, the chamfer can include one or more voids along the width W.

With reference to FIG. 3A, the chamfer 500 also defines a length L, which is measured between the front portion 30 and the crown portion 34. Like the width W, the length L varies depending on the club head type. For example, the length L of the chamfer 500 can be approximately 0.05 inches to 0.25 inches (e.g., 1.2 mm to 7.0 mm) for a fairway wood and approximately 0.15 inches to 0.25 inches (e.g., approximately 4 mm to 7 mm) for a driver. In one construction, the length L for a chamfer 500 of a fairway wood ranges from approximately 0.10 inches to 0.15 inches (e.g., approximately 2.5 inches to 7 mm) and approximately 0.18 inches to 0.22 inches (e.g., approximately 4.5 mm to 6 mm) for a chamfer 500 of a driver. The chamfer 500 also includes a maximum thickness T that extends from inner surface 503 to outer surface 504. Like the length L and the width W, the maximum thickness T varies depending on the club head type. For example, the maximum thickness T of the chamfer 500 can be approximately 0.025 to 0.070 inches (e.g., 0.63 mm to 1.78 mm) for a fairway wood and approximately 0.095 inches to 0.150 inches (e.g., approximately 2.41 mm to 3.81 mm) for a driver. In the illustrated embodiment the chamfer 500 has a rectangular cross-section but in other embodiments, the cross-section may be triangular or a polygonal having any number of sides (e.g., pentagon, hexagon, octagon, etc.). Alternatively, the cross-section may be semi-circular.

In many embodiments, a ratio of the maximum thickness T of the chamfer 500 to a thickness 502 of the crown measured adjacent to the chamfer 500 can be greater than 1.15. For example, the ratio of the maximum thickness T of the chamfer 500 to a thickness 502 of the crown measured adjacent to the chamfer 500 can be greater than 1.15, greater than 1.20, greater than 1.25, greater than 1.30, or greater than 1.35. In many embodiments, the ratio of the maximum thickness T of the chamfer 500 to a thickness 502 of the crown measured adjacent to the chamfer 500 can be between approximately 1.15-3.00 for a driver type club head, and the ratio of the maximum thickness T of the chamfer 500 to a thickness 502 of the crown measured adjacent to the chamfer 500 can be between approximately 1.15-4.00 for a fairway wood type club head. For example, in some embodiments, the ratio of the maximum thickness T of the chamfer 500 to a thickness 502 of the crown measured adjacent to the chamfer 500 can be approximately 1.25, approximately 1.50, approximately 1.75, approximately 2.00, approximately 2.25, approximately 2.50, approximately 2.75, approximately 3.00, approximately 3.25, approximately 3.50, approximately 3.75, or approximately 4.00.

In the illustrated embodiment, the thickness of the chamfer 500 between the outer surface 504 and an inner surface 503 is substantially constant along the width W of the chamfer 500. Further, in the illustrated embodiment, the maximum thickness 502 of the chamfer 500 is substantially constant along the width W of the chamfer 500. In other embodiments, the thickness of the chamfer 500 between the outer surface 504 and an inner surface 503 can vary along the width W of the chamfer 500. For example, in some embodiments, the thickness of the chamfer 500 between the outer surface 504 and an inner surface 503 can increase from near the heel portion 42 and near the toe portion 46 toward the center of the chamfer. Further, in other embodiments, the maximum thickness 502 can vary along the width W of the chamfer 500. For example, in some embodiments, the maximum thickness 502 can increase from near the heel portion 42 and near the toe portion 46 toward the center of the chamfer. In these or other embodiments, the maximum thickness 502 and/or the thickness of the chamfer 500 between the outer surface 504 and an inner surface 503 can taper or decrease from a center portion of the chamfer 500 toward the heel portion 42 and the toe portion 46 of the club head 10.

In many embodiments, the chamfer 500 can add approximately 0.50 grams to 2.0 grams of mass to the club head 10. For example, in the illustrated embodiment, the chamfer adds approximately 1.3 grams of mass to a driver type club head and approximately 0.5 grams of mass to a fairway wood type club head. In other embodiments, the chamfer 500 can add greater than approximately 0.5 grams, greater than approximately 0.75 grams, greater than approximately 1.0 grams, greater than approximately 1.25 grams, or greater than approximately 1.5 grams of mass to the club head 10.

The chamfer 500, as described herein, reinforces the strikeface 26 thereby increasing the durability of the club head 10 compared to conventional golf club heads. For example, in many embodiments, the club head 10 having the chamfer 500 can survive more impacts than a conventional club head without a chamfer.

For golf club heads 10 in which the angle c (shown in FIG. 3) is 35 degrees or less (or more preferably 20 degrees or less), the spin of the ball can also be reduced by giving the strikeface 26 a roughness average ($R_a$) value of 150±40. A $R_a$ value of 150±40 falls within the specifications required by the USGA, which allows for a RA value of 0-180±optimization. The above-referenced $R_a$ value in combination with the above-referenced ranges of loft angles generates a reduction in revolutions per minute (RPM) of the ball of 1 RPM per 1 $R_a$ unit. Therefore, if you have a $R_a$ value of 150 on the strikeface 26 and an angle ϵ of 35 degrees or less, there will be a reduction of 150 RPM ball spin.

With further reference to FIGS. 3 and 5, the golf club head 10 may also include an internal radius transition or cascading sole 600. The internal radius transition 600 can affect a peak bending of the sole of golf club head 10 and where it occurs. In addition, the internal radius transition 600 can engage more of the body of club head 10 in the bending process on impact from a golf ball. In the illustrated embodiment, the internal radius transition 600 includes a first tier 604, a second tier 608, and a third tier 610, a first tier transition region 614 between first tier 604 and second tier 608, a second tier transition region 616 between the second tier 608 and the third tier 610, and a third tier transition region 630. As illustrated herein, the internal sole thickness 620 is thicker than an adjacent tier or a final tier in the internal radius transition 600. Stress created by an impact of the strikeface 26 with the golf ball builds up on each of the tiers 604, 608, 610, rather than collecting primarily at the thinnest section, which increases the reliability and durability of the golf club head 10. In some embodiments, the internal radius transition 600 creates another plastic hinge 624 opposite the strikeface end of internal radius transition 600 and promotes more localized deformation at the plastic hinge location. This structure also can allow for the storage of more potential energy, for example, in the crown portion 34 and/or the sole portion 38. The additional bowing in the crown to sole direction at the sole portion 38 and/or the crown portion 34 can allow the strikeface 26 to bend further on the same loading or impact by the golf ball. Therefore, this structure can create more stress and bending in strikeface 26 of club head 10.

In FIGS. 3 and 5, the internal radius transition 600 is a tiered transition region having three tiers 604, 608, 610 having first, second, and third thicknesses, respectively. Also, the tiers 604, 608, 610 have first, second, and third slopes, respectively. As illustrated, the first and third slopes are such that the first and third thicknesses of the first and the third tiers 304 are thicker closer to the strikeface 26 and thinner closer to the tier transition region 614 and 630, respectively. The second slope, however, is approximately zero. In other embodiments, any or all of the thicknesses may be constant or sloping. The illustrated tier transition regions 614, 616, 620 have steeper slopes than the adjacent tiers 604, 608, 610. As illustrated, the tier transition regions 614, 616, 620 can be linearly sloped at an angle less than 90 degrees to transition from the adjacent tiers 604, 608, 610, or alternatively, can comprise an approximately 90 degree step (not shown herein).

Additionally, in additional embodiments there may be greater or fewer tiers than that illustrated herein. For example, there may be one tier, two tiers, four tiers, five tiers, or six tiers. Still in other embodiments the golf club head can comprise a single, continuous tiered transition region ring around a circumference of perimeter of the golf club head, for example a tiered transition region ring from the strikeface to each of the crown, the toe region, the heel region, and the sole region. In other embodiments, the golf club head comprises a tiered transition region only at the crown and/or at the sole. In some embodiments, the golf club head comprises a tiered transition region only at the toe region and/or at the heel region. In other examples, the tiered transition region is only located from the strikeface to the skirt. In other embodiments, the golf club head comprises separate or individual tiered transition regions from the strikeface to the toe region of the crown, the heel region of the crown, the toe region of the sole, and/or the heel region of the sole.

In the embodiment illustrated in FIGS. 3, 4, and 5, the golf club heads include both the chamfer 500 and the internal radius transition 600. When used together, the bowing of the crown and the sole portions 34, 38 is even greater, which improves the results discussed above with respect to the chamfer 500 and the internal radius transition 600. However, in other embodiments, such as that of FIGS. 6 and 7, the golf club head may include only the chamfer 500. Alternatively, the golf club head may include one of the internal radius transition 600.

Figure 1A:
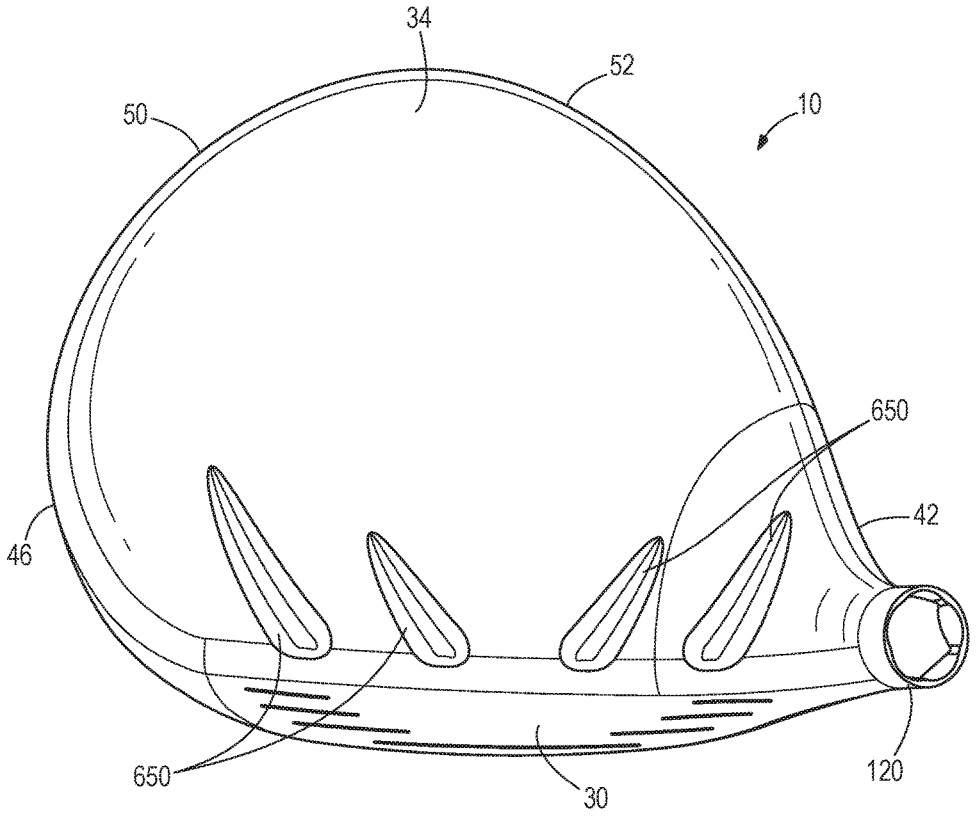
FIG. 1A illustrates a top view of the golf club head of FIG. 1.

As illustrated in FIGS. 1 and 1A, the golf club head 10 may also include one or a plurality of turbulators 650 that are positioned above the crown portion 34. Adjacent pairs of crown turbulators 650 are separate and spaced apart to define a space between the adjacent pair of crown turbulators 650. The space between each adjacent pair of crown turbulators 650 is substantially greater than the width of each of the adjacent pair of crown turbulators 650 that define the space. Each crown turbulator 650 in the illustrated embodiment extends between the heel portion 42 and the toe portion 46 to define a width and extends between the face portion 30 and the rear portion 50 to define a length. The length of the turbulator 650 is greater than the width of the turbulator.

Figure 12:
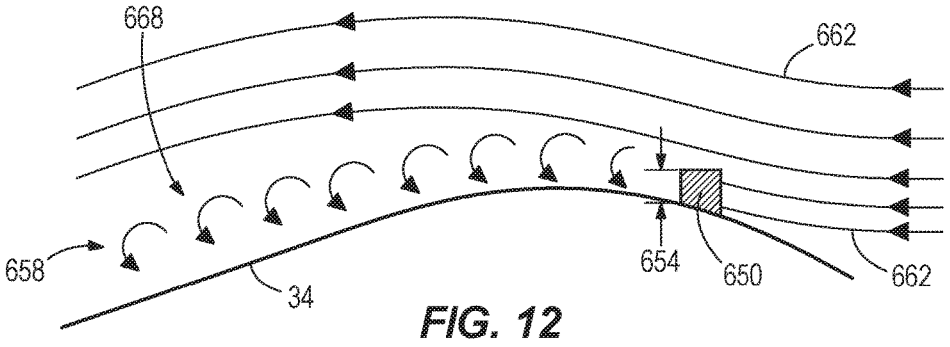
FIG. 12 illustrates a schematic cross-section of a turbulator according to one embodiment.

As illustrated in both FIGS. 1 and 12, each turbulator 650 projects upward from a surface of the crown portion 34 at a height 654 (FIGS. 1 and 12) such that it is inside a boundary layer 658 (FIG. 12). In particular, a highest point on the surface of the crown portion 34 defines an apex. At least a portion of at least one crown turbulator is located between the face portion 40 and the apex. FIG. 12 further illustrates how the turbulator 650 trips the air flowing over the crown portion 34 as shown by the streamline 662 to create turbulence 668 inside the boundary layer 658. The turbulence energizes the boundary layer 658 to delay separation of the air flow on the crown portion 34 and move a separation region toward the rear portion 50 of the crown portion 34. A detailed discussion of golf club heads having turbulators can be found in U.S. Pat. No. 8,608,587, entitled "GOLF CLUB HEADS WITH TURBULATORS AND METHODS TO MANUFACTURE GOLF CLUB HEADS WITH TURBULATORS", which is incorporated herein by reference.

The golf club head 710 of FIGS. 8-11 is similar to the golf club head 10 illustrated in FIGS. 1-5. Therefore, like structure will be identified by like reference numerals plus "700" and only the differences will be discussed hereafter. Although not illustrated, FIGS. 8-11 may include a chamfer or an internal radius transition or both in addition to the features discussed below.

Figure 11:
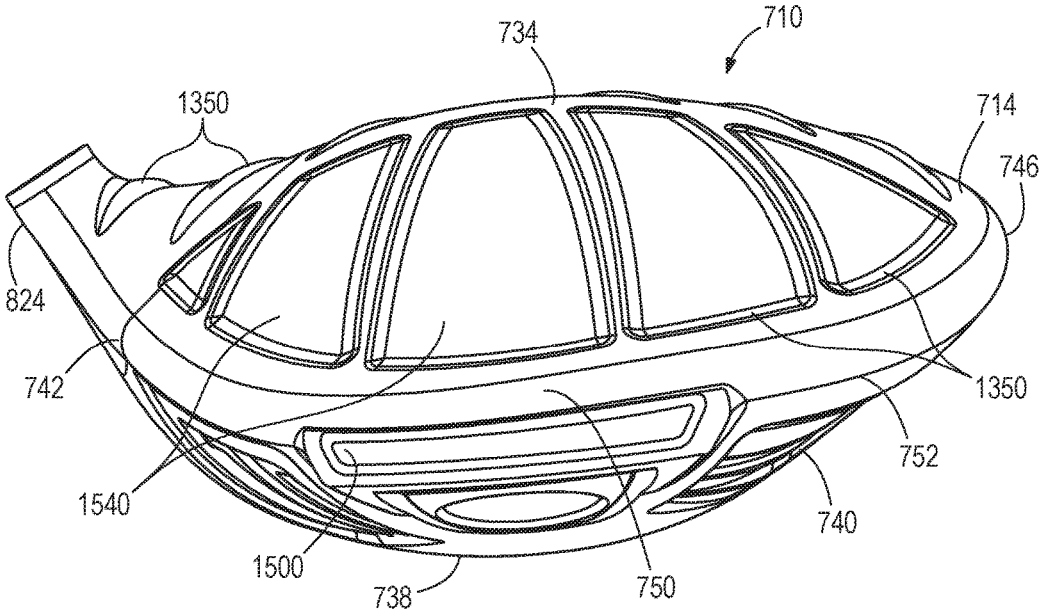
FIG. 11 illustrates a rear view of the golf club head of FIG. 8.

As illustrated in FIG. 11, the golf club head 710 includes a cavity 1500 in the body 714 that is spaced apart from the strikeface 726. As shown, the trailing edge 752 can include one or more cavities between the crown portion 734 and the sole portion 738. In the illustrated embodiment, the cavity 1500 is positioned opposite the strikeface 726 adjacent the rear portion 750. In other embodiments, it may be positioned at other locations to the strikeface 26 and in between the crown portion 734 and the sole portion 738. In other words, in the illustrated embodiment, the cavity 1500 is a back cavity but may be a side cavity in other embodiments. Also, there may be more than one cavity 1500 in some embodiments. For example, there could be a toe-side cavity and a heel-side cavity in the rear portion 750. Another example would be two or more cavities stacked on top of one another between the crown portion 734 and the sole portion 738.

In fluid dynamics, vortices are shed in an oscillating flow when air flows past a body, such as in the golf club head 710. This vortex shedding depends on the size and shape of the body, or the size and shape of the golf club head 710. In many embodiments, the cavity 1500 can be designed to break vortices generated behind the golf club head 710 into smaller vortices and reduce drag. In some embodiments, breaking the vortices into smaller vortices can generate a region of high pressure behind the golf club head 710. This region of high pressure can push golf club head 710 forward and enhance the aerodynamic design. In many embodiments, the net effect of smaller vortices and reduced drag is an increase in the speed of the golf club head 710. This can lead to higher speeds at which the golf ball leaves the strikeface 726 after impact.

When the golf club head 710 is at an address position, the golf club head 710 is at a closed club face angle, for example, 90 degrees to a drag force. At the closed club face angle, or 90 degrees to the drag force, the cavity 1500 can improve drag reduction by approximately 6 percent to approximately 12 percent. During a downswing, the golf club head 710 is at an open club face angle of approximately 0 degrees to approximately 89 degrees to the drag force. In some embodiments, at approximately 50 degrees, the cavity 1500 can improve drag reduction by approximately 0.1 percent to approximately 3 percent. In some embodiments, vortex shedding behind the golf club head 710 is shifted toward toe portion 746 for open club face angles. In these embodiments, cavity 1500 can be extended toward the toe portion 746 to improve drag reduction at open club face angles. For example, the cavity 1500 can be extended toward the toe region 746.

In some embodiments, the cavity 1500 can have a maximum head-to-toe width of approximately 1.75 inches to approximately 8 inches. In some embodiments, the cavity 1500 can have a width of approximately 1.75 inches to approximately 3.0 inches. The cavity 1500 can have a sole-to-crown height of approximately 0.19 inch to approximately 0.21 inch. If there is more than one cavity and the cavities are stacked, each of the cavities 1500 can have a maximum height of approximately 0.19 inch to approximately 0.21 inch. In other embodiments, the one or more cavities 1500 can have a total combined maximum height of approximately 0.19 inch to approximately 0.21 inch. In some embodiments, the cavity 1500 can have a maximum depth of approximately 0.050 inch to approximately 0.250 inch. In some embodiments, the cavity 1500 of FIG. 1 can have a different width, height, and/or length than that illustrated herein. In some embodiments, the cavity 1500 can have a varying height. For example, a toe-side height at the toe-side of the cavity 1500 can be greater than a heel-side height at the heel-side of the cavity 1500. In some embodiments, the heel-side height can be greater than a toe-side height. In some embodiments, the height of the cavity 1500 can vary throughout or only partially throughout the length of the cavity 1500. In other embodiments, the cavity 1500 can have a max height at the center and the same or different smaller heights at the ends of the cavity 1500. In some embodiments, the cavity 1500 can have a varying depth. For example, the cavity 1500 can have a toe-side depth that is greater than a heel-side depth. In some embodiments, the heel-side depth can be greater than the toe-side depth. In other embodiments, the depth of the cavity 1500 can vary throughout the length of the cavity 1500. In other embodiments, cavity 1500 can have a maximum depth at the center, and shallower depths at the ends of cavity 1500.

In the embodiment of FIG. 11, the cavity 1500 can has an inner profile shape that is rounded. In other embodiments, the cavity 1500 can have a different inner profile shape, such as a triangular or polygonal inner profile shape, for example.

As illustrated in FIGS. 8-11, the golf club head 710 includes external ribs 1530 in the crown portion 734. The illustrated ribs 1530 are formed as one piece with the golf club head 700, which will be discussed below. In particular, the ribs 1530 are polygonal ribs that are each form a perimeter of a recess 1534 in the crown portion 734. The recesses 1534 create sections in the crown portion 734 that have a thickness that is thinner than the ribs 1530. While the head is cast thin, additional weight is removed through the chemical etching of the interior surfaces to achieve the dimension of less than 0.020 inches. The recesses can also be included with the golf club head mold.

Another feature of the golf club head 710 is ribs 1540 added internally to the surface of the crown portion 734. Although not illustrated herein, the ribs 1540 may also be added to the sole and/or the skirt portions 738, 740, as well. The ribs 1540 improve casting quality and reinforcement. The ribs 1540 are positioned below and substantially in the middle of a respective recess 1534 in the crown portion for improved casting quality. Therefore, the ribs 1540 provide reinforcement regions for the sections of the recesses 1534. The ribs 1540 also improve feel, sound and durability of the recesses 1540. Furthermore, the rib dimensions vary, but comprise widths of 0.030"-0.250" with a height range of 0.005"-0.030".

Accordingly, the recesses 1534 eliminate material, and therefore weight, from the golf club head 734 while the ribs 1530 provide the necessary structural stability for the golf club head 734. In the illustrated embodiment, there are four recesses 1534, but in other embodiments there may be greater or fewer recesses 1534. Similarly, there are four ribs 1540 connected by a spine-like rib. However, the ribs 1540 may have any suitable configuration or number. In particular, the golf club head 710 may have external ribs 1530 and/or internal ribs 1540 having various asymmetrical or symmetrical patterns, shapes, and sizes.

Either or both of the external or the internal ribs 1530, 1540 may affect the sound upon impact of the golf club head 10 with the ball.

A golf club head having all of the features discussed herein or any combination of the features discussed herein is within the scope of the disclosure.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

What is claimed is:

1. A golf club head comprising:
- a hollow body comprising
  - a front portion having a strikeface;
  - a heel portion;
  - a toe portion opposite the heel portion;
  - a sole portion;
  - a rear portion;
  - a crown portion;
  - a chamfer extending between the front portion and the crown portion, the chamfer having an inner surface and an outer surface, wherein the chamfer defines a hinge point of the crown portion; and
  - an internal radius transition from the strikeface to the sole portion comprising:
    - a first tier directly adjacent to the strikeface;
    - a second tier directly adjacent to the first tier;
    - a third tier directly adjacent to the second tier;
    - a first tier transition region between the first tier and the second tier; and
    - a second tier transition region between the second tier and the third tier;
  - wherein:
    - the first tier comprises a first substantially constant thickness;
    - the second tier comprises a second substantially constant thickness smaller than the first substantially constant thickness;
    - the third tier comprises a third substantially constant thickness smaller than the first substantially constant thickness and the second substantially constant thickness; and
    - the internal radius transition is not visible from an exterior of the golf club head.

2. The golf club head of claim 1, wherein the golf club head is a driver, the chamfer having:
- a width of between approximately 0.75 inches and approximately 4.50 inches;
- a length of between approximately 0.15 inches and approximately 0.25 inches; and
- a maximum thickness of between approximately 0.095 inches and approximately 0.150 inches, wherein the maximum thickness is measured between the inner surface and the outer surface of the chamfer.

3. The golf club head of claim 1, wherein the golf club head is a fairway wood, the chamfer having:
- a width of between approximately 0.75 inches and approximately 3.50 inches;
- a length of between approximately 0.05 inches and approximately 0.25 inches;
- a maximum thickness of between approximately 0.025 inches and approximately 0.070 inches, wherein the maximum thickness is measured between the inner surface and the outer surface of the chamfer.

4. The golf club head of claim 2, wherein a ratio of the maximum thickness to a thickness of the crown measured adjacent to the chamfer is between approximately 1.15 and 3.00.

5. The golf club head of claim 3, wherein a ratio of the maximum thickness to a thickness of the crown measured adjacent to the chamfer is between approximately 1.15 and 4.00.

6. The golf club head of claim 1, wherein the strikeface defines a loft plane and the hinge point is spaced apart from the loft plane by a minimum of approximately 0.16 inches in a direction perpendicular to the loft plane.

7. The golf club head of claim 1, wherein the chamfer defines a plane tangent to the inner surface of the chamfer, and an angle between the chamfer plane and a loft plane is approximately 45°.

8. The golf club head of claim 1, wherein a golf ball upon impact has a spin reduction of 100-400 rpm over a club head without the chamfer.

9. The golf club head of claim 1, wherein the strikeface has a surface roughness between 110 $R_a$ and 190 $R_a$.

10. A golf club comprising:
- a hollow-bodied head comprising:
  - a front portion having a strikeface;
  - a heel portion;
  - a toe portion opposite the heel portion;
  - a sole portion;
  - a rear portion;
  - a crown portion;
  - a chamfer extending between the front portion and the crown portion, the chamfer having an inner surface and an outer surface, wherein the chamfer defines a hinge point of the crown portion;
  - a shaft coupled to the hollow-bodied golf club head; and
  - an internal radius transition from the strikeface to the sole portion comprising:
    - a first tier directly adjacent to the strikeface;
    - a second tier directly adjacent to the first tier;
    - a third tier directly adjacent to the second tier;
    - a first tier transition region between the first tier and the second tier; and
    - a second tier transition region between the second tier and the third tier;
  - wherein:
    - the first tier comprises a first substantially constant thickness;
    - the second tier comprises a second substantially constant thickness smaller than the first substantially constant thickness;

the third tier comprises a third substantially constant thickness smaller than the first substantially constant thickness and the second substantially constant thickness; and the internal radius transition is not visible from an exterior of the golf club head.

11. The golf club of claim 10, wherein the golf club is a driver, and the chamfer has:

a width of between approximately 0.75 inches and approximately 4.50 inches;

a length of between approximately 0.15 inches and approximately 0.25 inches; and a maximum thickness of between approximately 0.095 inches and approximately 0.150 inches, wherein the maximum thickness is measured between the inner surface and the outer surface of the chamfer.

12. The golf club of claim 10, wherein the golf club is a fairway wood, and the chamfer has:

a width of between approximately 0.75 inches and approximately 3.50 inches;

a length of between approximately 0.05 inches and approximately 0.25 inches;

a maximum thickness of between approximately 0.025 inches and approximately 0.070 inches, wherein the maximum thickness is measured between the inner surface and the outer surface of the chamfer.

13. The golf club of claim 11, wherein a ratio of the maximum thickness to a thickness of the crown measured adjacent to the chamfer is between approximately 1.15 and 3.00.

14. The golf club of claim 12, wherein a ratio of the maximum thickness to a thickness of the crown measured adjacent to the chamfer is between approximately 1.15 and 4.00.

15. The golf club of claim 10 wherein the strikeface defines a loft plane and the hinge point is spaced apart from the loft plane by a minimum of 0.16 inches in a perpendicular direction.

16. The golf club of claim 10, wherein the chamfer defines a plane tangent to the inner surface of the chamfer, and an angle between the chamfer plane and a loft plane is approximately 45°.

17. The golf club of claim 10, wherein a golf ball upon impact has a spin reduction of 200-400 rpm over a club head without the chamfer.

18. The golf club of claim 10, wherein strikeface has a surface roughness between 110 and 190 $R_a$.

19. A method of manufacturing a golf club head, comprising:

providing a body, the body having:

a front portion having a strikeface;

a heel portion;

a toe portion opposite the heel region;

a sole portion;

a rear portion;

a crown portion;

a chamfer extending between the front portion and the crown portion, the chamfer having an inner surface and an outer surface, wherein the chamfer defines a hinge point of the crown portion; and an internal radius transition from the strikeface to the sole portion comprising:

a first tier directly adjacent to the strikeface;

a second tier directly adjacent to the first tier;

a third tier directly adjacent to the second tier;

a first tier transition region between the first tier and the second tier; and a second tier transition region between the second tier and the third tier;

wherein:

the first tier comprises a first substantially constant thickness;

the second tier comprises a second substantially constant thickness smaller than the first substantially constant thickness;

the third tier comprises a third substantially constant thickness smaller than the first substantially constant thickness and the second substantially constant thickness; and the internal radius transition is not visible from an exterior of the golf club head.

* * * * *